US007712239B2

(12) United States Patent
Pitcher et al.

(10) Patent No.: US 7,712,239 B2
(45) Date of Patent: May 11, 2010

(54) OVERHEAD ADJUSTABLE TRACK SUPPORT ARRANGEMENT

(75) Inventors: David E. Pitcher, Swampscott, MA (US); Rebecca C. Suciu, Lynn, MA (US); Thomas P. Burrous, Haverhill, MA (US); Alan Stenfors, Scituate, MA (US); Sidney Rose, Marblehead, MA (US)

(73) Assignee: Rose Displays, Ltd., Salem, MA (US)

( * ) Notice: Subject to any disclaimer, the term of this patent is extended or adjusted under 35 U.S.C. 154(b) by 156 days.

(21) Appl. No.: 11/897,179

(22) Filed: Aug. 29, 2007

(65) Prior Publication Data

US 2009/0056186 A1 Mar. 5, 2009

(51) Int. Cl.
*G09F 7/22* (2006.01)

(52) U.S. Cl. ..... 40/617; 248/343; 52/39

(58) Field of Classification Search ..... 40/617; 248/343; 52/39, 38, 243.1; 403/252, 253, 403/326

See application file for complete search history.

(56) References Cited

U.S. PATENT DOCUMENTS 4,490,064 A * 12/1984 Ducharme ..... 403/255
5,381,991 A * 1/1995 Stocker ..... 248/206.5
5,409,191 A * 4/1995 Wenmaekers ..... 248/317
6,960,045 B2 * 11/2005 Schmalzhofer ..... 403/252

* cited by examiner

*Primary Examiner*—Joanne Silbermann
(74) *Attorney, Agent, or Firm*—Don Halgren

(57) ABSTRACT

A system for supporting display panels from an overhead support, comprising: two or more spaced-apart, elongated, hollow, extruded fixed rails which are attachable to an overhead support together with one or more spaced-apart, elongated, hollow, extruded moveable rails. A plurality of connectors are slidably disposed within the fixed rails, the connectors having a projection extending though an elongated gap in the moveable rail and into slidable receipt in the fixed rail. The moveable rails provide support for a display supporting clip.

14 Claims, 6 Drawing Sheets

OVERHEAD ADJUSTABLE TRACK SUPPORT ARRANGEMENT

BACKGROUND OF THE INVENTION

1. Field of the Invention

This invention relates to alignable overhead support systems for hanging displays such as signs and panels or other objects from ceilings or overhead rails or the like, which support system is fully adjustable in a plane normal to the vertical axis.

2. Prior Art

Commercial establishments always need overhead display support for signage, merchandising, and the like. The signage which is intended to be hung from such overhead arrangements typically needs to be changed on a regular basis.

Often, such signage or support members may need to be attached to an overhead ceiling which does not have any structure to attach to, such as grid, as in the case of plaster ceilings.

It is an object of the present invention, to provide a system of supports which are moveable, and may overcome any surface irregularities in the overhead support structure.

It is a further object of the present invention, to overcome the disadvantages of the prior art.

It is still yet a further object of the present invention, to provide an overhead support system which is adjustable, maneuverable, and readily changeable, permitting the objects that they support, to be readily changed and/or accommodated as needed.

BRIEF SUMMARY OF THE INVENTION

The present invention comprises an overhead rail system for supporting a display or a signage arrangement in an accommodative manner, from an overhead support such as a ceiling or the like. The overhead rail system in a first preferred embodiment thereof, comprises two or more elongated fixed rails, each individually and separately secured to an overhead building component, such as a ceiling. Such elongated fixed rails need not necessarily be parallel with one another when they are secured to the overhead building (ceiling) component, for reasons which will be discussed hereinbelow, although parallel is preferred. The overhead adjustable track system also includes one or more elongated moveable rails. Each elongated fixed rail and each elongated moveable rail are preferably structurally the same for ease of manufacture, although they do not need to be for the system to function.

Such elongated fixed rail and such an elongated moveable rail hence preferably have corresponding cross-sectional configurations. Each such rail has an elongated extruded base having a first elongated flange extending along one side thereof and a second elongated flange extending along the opposite side thereof. The first elongated flange has a first inwardly extending lip running along a distal edge of the first flange. The second flange has a second inwardly directed lip extending along a distal edge of the second flange. The first and second inwardly facing lips have an elongated gap running therebetween. An elongated central channel is defined between the elongated base and the first and second elongated flanges with their respective first and second inwardly directed lips. A first side rail extends off the elongated base at a first edge thereof. A second elongated side rail extends off the second edge of the elongated base. Each side rail has a pinched waist portion with a rounded edge thereon.

The overhead adjustable track system includes a connector. The connector comprises a shallow "clothes hanger" shaped member having a first shoulder and a second shoulder which are each tapered to a narrowed first end and tapered to a narrowed second end. The first tapered end and the tapered second end are connected with a curvilinear main web extending therebetween.

An engaging projection extends connected transversely with respect to the first and second shoulders, from a midpoint thereof, and pointing away from the curvilinear main web. The extending projection has a distal tip with a first channel lip engaging flange on one side and a second channel lip engaging flange on the other side. The projection is inwardly collapsible so as to make its width narrower as will be defined hereinbelow.

The connector has a transverse axis which extends between the tapered first end and the tapered second end. That transverse axis is arranged to be in longitudinal alignment with the longitudinal axis of the elongated central channel within the elongated moveable rail. The projection of the connector extends through the elongated gap between the first inwardly directed lip and the second inwardly directed lip on the elongated fixed rail and is slidable therewithin for adjustment purposes thereof. The elongated rails may have a first end cap and a second end cap which sealingly plug the open end of each end of the elongated central channel. The projections of each connector may be slidingly arranged within the elongated channel of the elongated fixed rail.

The projections extending from the elongated gap between inwardly directed lips may, during the assembly process, be pushed so as to be inserted within the elongated gaps between the lips of the elongated fixed rails which may be facing downwardly from its point of attachment to an overhead support such as a ceiling or the like. Such projections may slide within the elongated gap of the fixed rail to allow for slidability of the moveable rails.

The tapered shoulders of the connector which are disposed within the elongated central channel of the elongated moveable rail permit a sliding motion of the connector therewithin, to accommodate any irregularities or disparities of non-parallel alignment between the respective fixed rails to which the moveable rails are secured.

The elongated rails utilized as the fixed rails may be hand drilled on site, and have a threaded fastener member or the like extending therethrough into a ceiling or overhead support. The tip of the projection of the connector is spaced sufficiently apart from any head of a threaded connector so as to permit slidable movement of the connector with respect to the fixed rail.

In a yet further embodiment of the securement portion for the adjustable track system, the elongated fixed rails may be threadedly secured through an arrangement of ceiling fixed tubes by for example, a threaded securement member extending into the lower end of those ceiling anchor tubes through the elongated base of that fixed rail.

The invention thus comprises a system for supporting display panels or other objects from an overhead support, comprising: preferably two or more spaced-apart, elongated, hollow, extruded fixed rails which are attachable to an overhead support; preferably one or more spaced-apart, elongated, hollow, extruded moveable rails; a plurality of connectors slidably disposed within the fixed rails, the connectors having a projection extending though an elongated gap in the moveable rail and into slidable receipt in the fixed rail, the moveable rails providing support for a display supporting clip.

The connector is also preferably slidable within the moveable rail. The connector preferably has tapered shoulders to permit the accommodative slidability within the rail. The fixed rail preferably has an elongated gap for pushed receipt of the projection of the connector.

The fixed rails may be arranged non-parallel with one another. The projection on the connector may have a pair of channel lip-engaging flanges disposed thereon for snapping into the gap on an adjoining opposed rail. The fixed rails and the moveable rails are preferably structurally similar to one another, although they do not need to be. The connector has a transverse axis which is movable with respect to a longitudinal axis of said fixed rail. The tapered shoulders at each end of the connector are connected by a curvilinear main web and their connection to the side portions of the projection.

The invention also includes a method of supporting a display panel or other object from an overhead support, comprising one or more of the following steps of: attaching a first elongated extruded hollow fixed rail to the overhead support; placing further elongated extruded hollow fixed rails to the overhead support; sliding a tapered shouldered connector into an elongated extruded hollow moveable rail, wherein the connector has a projection extending out of the moveable rail, through an elongated gap therealong; pushing the projection extending from the moveable rail into the elongated gap extending along the fixed rail; attaching the moveable rail to the further fixed rails by further connectors extending from the moveable rail; and attaching a clip to the moveable rail for support of a display panel or other object therefrom. The first elongated fixed rail may be generally parallel to the second fixed rail. The first fixed rail may also be arranged in a non-parallel relationship with the second fixed rail. The method may include sliding the projection into the elongated gap in the fixed rail from one end.

BRIEF DESCRIPTION OF THE DRAWINGS

The objects and advantages of the present invention will become more apparent, when viewed in conjunction with the following drawings in which.

DETAILED DESCRIPTION OF THE PREFERRED EMBODIMENTS

Figure 1:
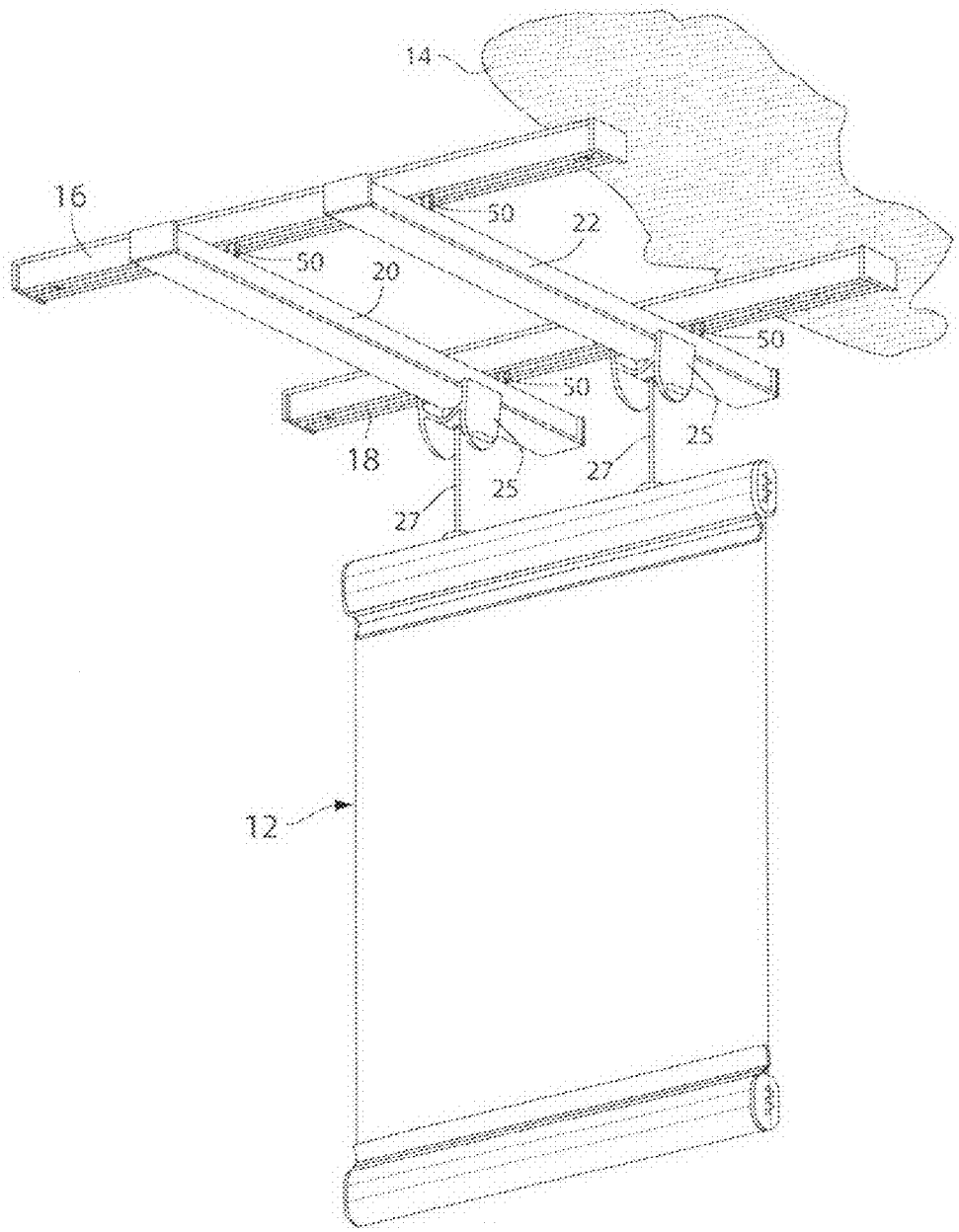
FIG. 1 is a perspective view of an overhead adjustable track system constructed according to the principles of the present invention, showing a sign member being supported between a pair of elongated moveable rails.

Referring now to the drawings in detail, and particularly to FIG. 1, there is shown the present invention which comprises an overhead adjustable track system 10 for supporting a display or a signage arrangement 12 in an accommodative manner, from an overhead support such as a ceiling 14 or the like. The overhead adjustable track system 10 in a first preferred embodiment thereof, comprises a first elongated fixed rail 16 and a second elongated fixed rail 18, each individually and separately secured to an overhead building component, such as the ceiling 14. Such first and second elongated fixed rails 16 and 18 need not necessarily be parallel with one another when they are secured to the overhead building component, for reasons which will be discussed hereinbelow, although parallel installation is preferred. The overhead adjustable track system 10 as illustrated also includes a first elongated moveable rail 20 and a second elongated moveable rail 22. Each elongated fixed rail 16 and 18 and each elongated moveable rail 20 and 22 are preferably structurally the same for ease of manufacturability, but do not need to be. The movable rails 20 and 22 each preferably have a clip 25 attached thereto, as shown in FIG. 1, for supporting the sign 12 therefrom by a connective line 27.

Figure 2:
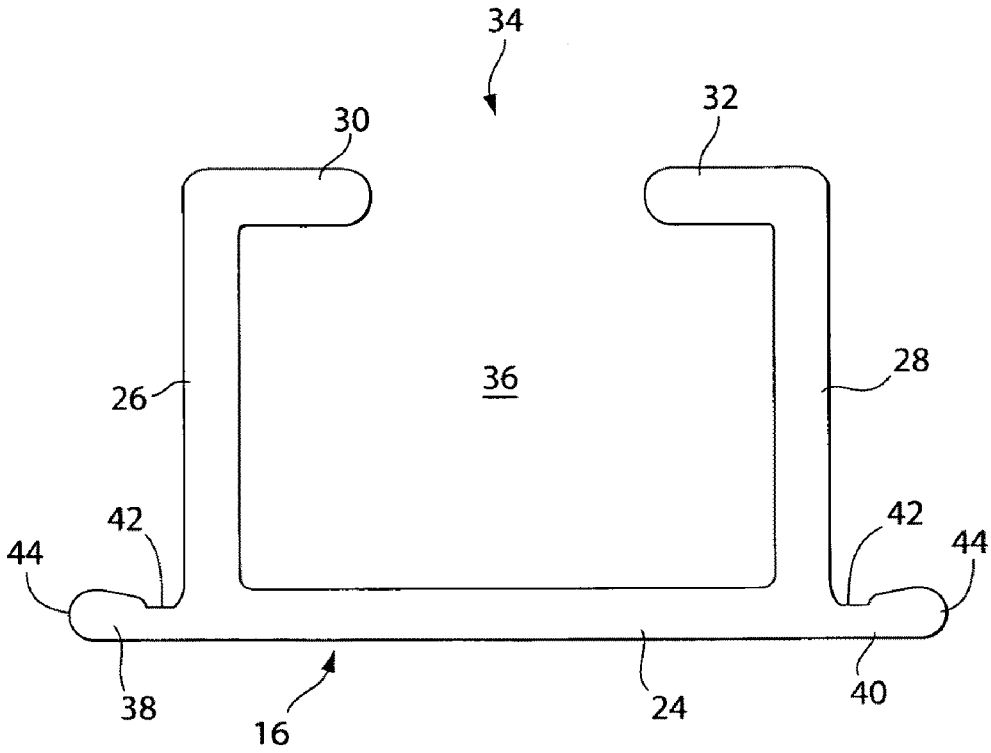
FIG. 2 is a cross-sectional view of an elongated rail, which could be either a fixed rail or a moveable rail.

Such elongated fixed rail 16 and such an elongated moveable rail 20 hence preferably have corresponding cross-sectional configurations, as is represented for example, in FIG. 2. Each such rail 16 and/or 20 has an elongated extruded base 24 having a first elongated flange 26 extending along one side thereof and a second elongated flange 28 extending along the opposite side thereof. The first elongated flange 26 has a first inwardly extending lip 30 running along a distal edge of the first flange 26. The second flange 28 has a second inwardly directed lip 32 extending along a distal edge of the second flange 28. The first and second inwardly facing lips 30 and 32 have an elongated gap 34 running therebetween. An elongated central channel 36 is defined between the elongated base 24 and the first and second elongated flanges 26 and 28 with their respective first and second inwardly directed lips 30 and 32. A first side rail 38 extends off the elongated base 24 from a first edge thereof. A second elongated side rail 40 extends off the second edge of the elongated base 24. Each side rail 38 and 40 has a pinched waist portion 42 with each side rail 38 and 40 having an outer rounded edge 44 thereon, as shown in FIG. 2.

Figure 3:
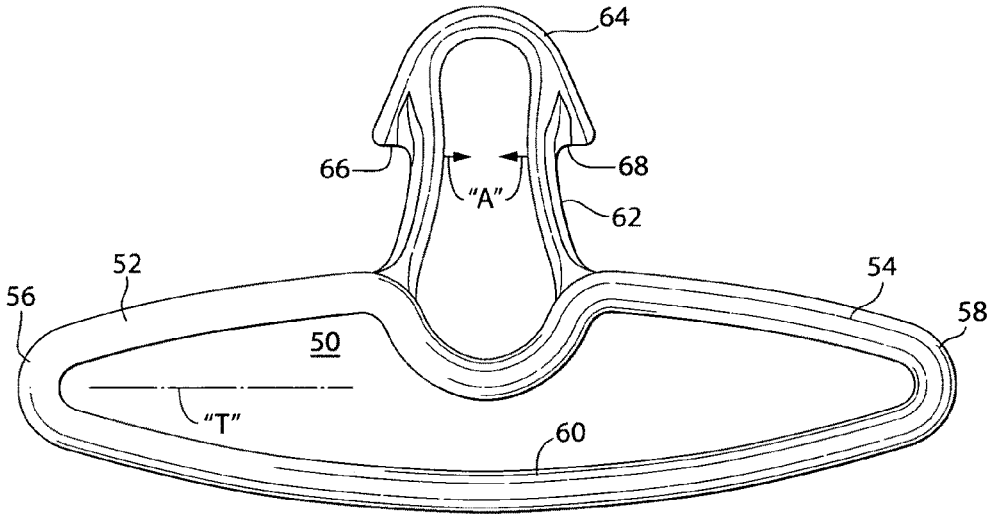
FIG. 3 is a side elevational view of a connector, showing the tapered shoulders on each side thereof, and its connected pinchable projection extending transversely from a midpoint thereof.
Figure 4:
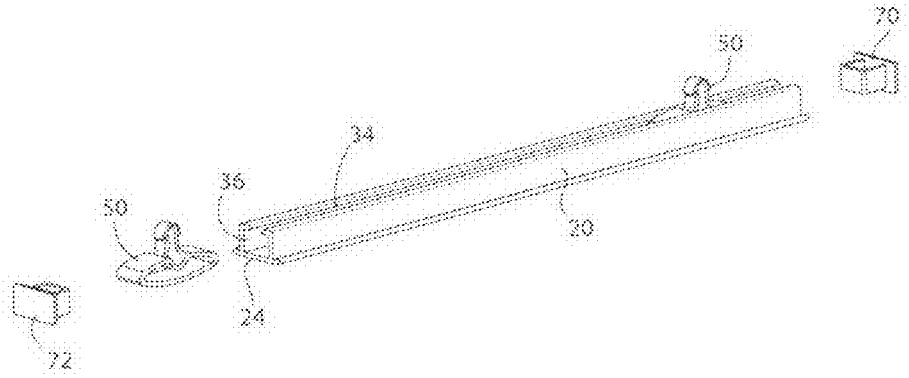
FIG. 4 is an exploded view of a moveable rail showing the procedure of a connector being inserted into an elongated rail and end caps arranged for placement thereon.
Figure 5:
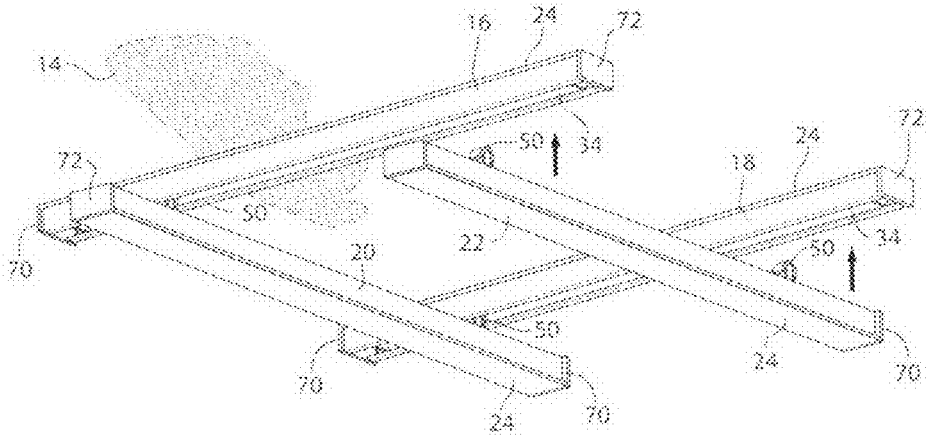
FIG. 5 is a perspective view showing a pair of elongated fixed rails attached to an overhead support, and a pair of elongated moveable rails being attached therewith.

The overhead rail system 10 includes a connector 50, as best shown in FIG. 3 and also shown partially in FIGS. 1, 4, 5 and 6. The connector 50 comprises a shallow "clothes hanger" shaped member (see FIG. 3) having a first shoulder 52 and a second shoulder 54 which are each tapered to a narrowed first end 56 and a tapered narrowed second end 58. The first tapered end 56 and the tapered second end 58 are connected with a curvilinear main web 60 extending therebetween.

An engaging projection 62 extends connected to and transversely with respect to the first and second shoulders 52 and 54, from a midpoint thereof, and pointing away from the curvilinear main web 60. The extending projection 62 has a distal tip 64 with a first channel lip engaging flange 66 on one side and a second channel lip engaging flange 68 on the other side, as shown in FIG. 3. The projection 62 is squeezably pinchable as represented by arrows "A" so as to collapse and make its width narrower for insertion through gap 34, as will be recited hereinbelow.

Figure 6:
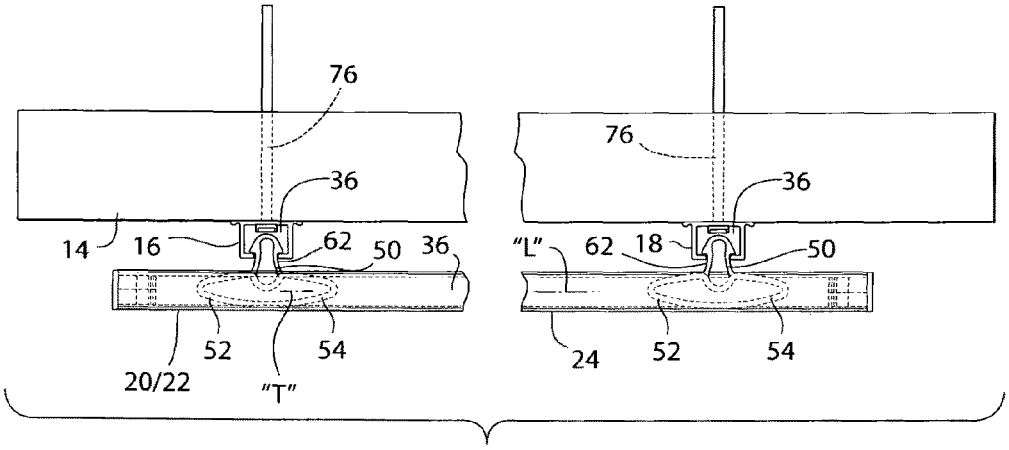
FIG. 6 is a side elevational view showing a longitudinal representation of an elongated moveable rail attached to an elongated fixed rail in transverse viewing.

The connector 50 has a transverse axis "T" which extends between the tapered first end 52 and the tapered second end 54, shown in FIG. 3. That transverse axis "T" is arranged in longitudinal alignment with the longitudinal axis "L" of the elongated central channel 36 within the respective elongated adjustment extrusions 20 and 22, as represented in FIG. 6. The projection 62 of the connector 50 extends through the elongated gap 34 between the first inwardly directed lip 30 and the second inwardly directed lip 32 on the elongated moveable rail 20 and 22, and into the elongated gap 34 on the fixed rail 16 and 18 and is slidable therewithin for adjustment purposes thereof. It is to be noted that such connector 50 could be inserted within the elongated central channel 36 of either the fixed rail 16 or 18 and project into the moveable rail 20 or 22, or vice versa. The elongated rails 16 and 18 and 20 and 22 may have a first end cap 70 and a second end cap 72 which sealingly plug the open end of each end of the elongated central channel 36. The projections 62 of each connector 50 may be slidingly arranged within the elongated channel 36 of the elongated fixed rail 16 and 18.

The projection 62 of each connector 50 is pushed between inwardly directed lips 30 and 32 and may, during the assembly process, collapse inwardly so as to be receivingly inserted within the elongated gaps 34 between the lips 30 and 32 of the elongated fixed rails 16 and 18 which may be facing downwardly from its point of attachment to an overhead support such as a ceiling 14 or the like. Such projections 62 may slide within the elongated gap 34 of the fixed rail 16 while the lower shape formed by shoulders 52/54 and bridge 60 allow the connector 50 to slide within the elongated gap 34 of the elongated moveable rail 20 to accommodate spacing variations between the fixed rail 16/18 and/or the moveable rails 20/22.

The tapered shoulders 52 and 54 of the connector 50 which are disposed within the elongated central channel 36 of the elongated moveable rail 20/22 permit a sliding motion of the connector 50 therewithin, to accommodate any irregularities or disparities of non parallel alignment between the respective fixed rails 16 and 18 to which the moveable rails 20 and 22 are secured.

The elongated rails (preferably extruded aluminum) utilized as the fixed rails 16 and 18 may be hand drilled on site, and may then have for example, a threaded fastener member 76 or the like extending therethrough into a ceiling or overhead support 14, as represented in FIG. 6. The distalmost tip 64 of the projection 62 of the connector 50 is spaced sufficiently apart from any head of a threaded connector 76 so as to permit slidable adjustability of the connector 50 with respect to the fixed rail 16/18 as well as to the elongated moveable rail 20/22.

Figure 7:
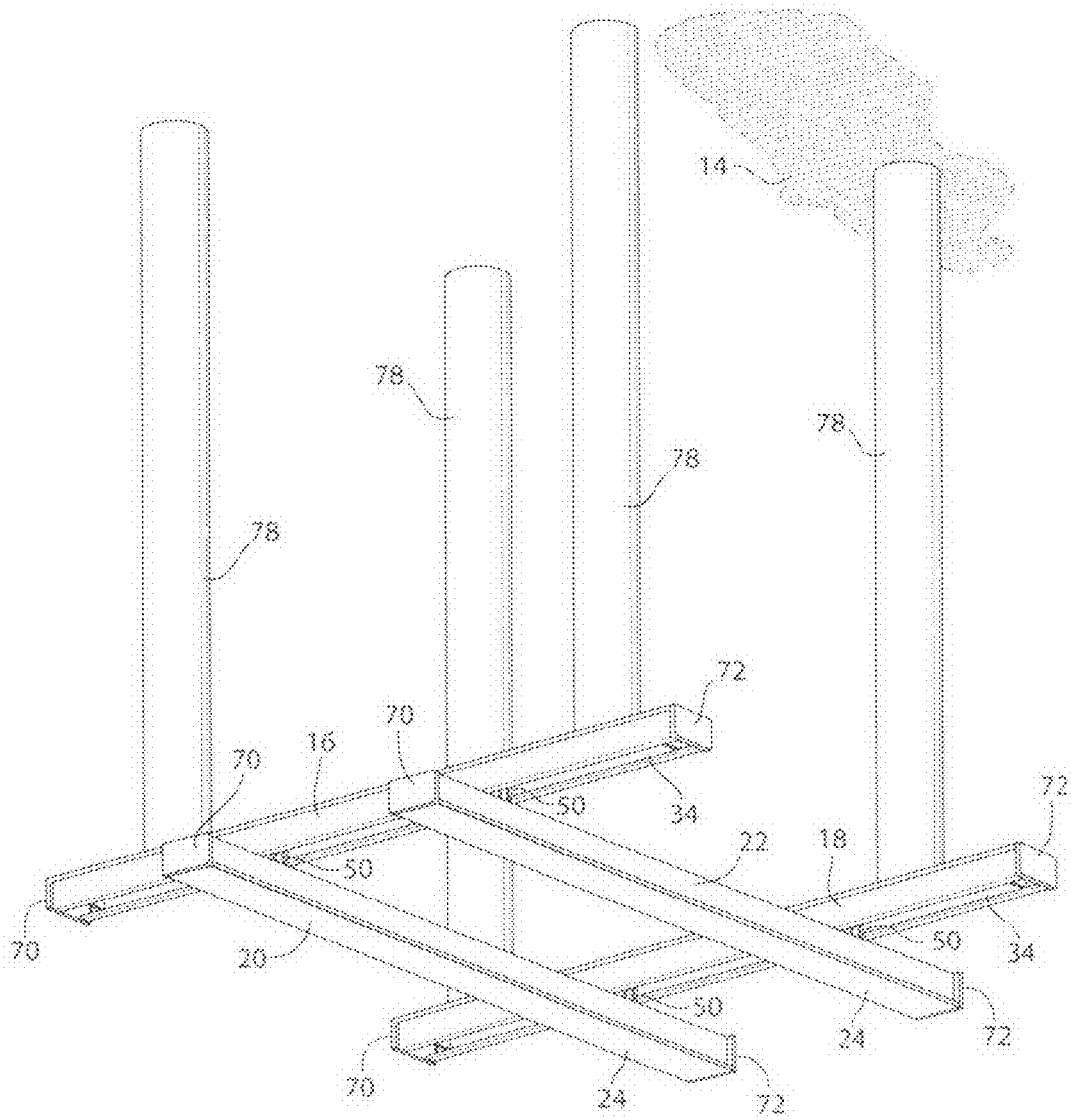
FIG. 7 is a perspective view of an overhead adjustable track system attached to one another and secured to a plurality of ceiling fixed tubes, the upper end of which are secured to an overhead support such as a ceiling.

In a yet further embodiment of the securement portion for the adjustable track system 10, the elongated fixed rails 16 and 18 may be threadedly secured through an arrangement of ceiling fixed tubes 78 by, for example, a threaded securement member (not shown for clarity of view) extending into the lower end of those ceiling fixed tubes 78 through the elongated base 24 of that fixed rail 16/18, as represented in FIG. 7.

We claim:

1. A system for supporting display panels from an overhead support, comprising:

at least two spaced-apart, elongated, hollow, extruded fixed rails which are attachable to an overhead support;

at least one spaced-apart, elongated, hollow, extruded moveable rail;

a plurality of connectors slidably disposed within said moveable rail, said connectors having a squeezingly narrowable projection extending though an elongated gap in said moveable rail and into respective adjustable receipt in each of said extruded fixed rails, said at least one moveable rail providing support for a supporting clip.

2. The system as recited in claim 1, wherein said connector is slidable within said moveable rail.

3. The system as recited in claim 2, wherein said connector has tapered shoulders to permit accommodated slidability within said rail.

4. The system as recited in claim 3, wherein said tapered shoulders at each end of said connector are connected by a curvilinear main web.

5. The system as recited in claim 2, wherein said projection on said connector has a pair of channel lip-engaging flanges disposed thereon for snapping into said gap on an adjoining opposed rail.

6. The system as recited in claim 1, wherein said fixed rail has an elongated gap for pushed receipt of said projection of said connector.

7. The system as recited in claim 1, wherein said fixed rails and said at least one moveable rail are structurally similar to one another.

8. The system as recited in claim 1, wherein said connector has a transverse axis, said connector being movable along a central elongated chamber of said fixed rail.

9. A method of providing support for a display panel from an overhead support, comprising:

attaching a first elongated extruded hollow fixed rail to said overhead support;

sliding a tapered shouldered connector into an elongated extruded hollow moveable rail, wherein said connector has a squeezably distortable projection extending out of said moveable rail, through an elongated gap therealong;

squeezingly narrowing said distortable projection while inserting said projection extending from said moveable rail into an elongated gap extending along a side portion of said fixed rail; and attaching a clip to said moveable rail for support of a display panel or other object therefrom.

10. The method as recited in claim 9, including:

placing at least one additional elongated extruded hollow fixed rail to said overhead support; and attaching said moveable rail to said additional fixed rail by a further connector extending from said moveable rail.

11. The method as recited in claim 10, wherein said first elongated fixed rail is generally parallel to said second fixed rail.

12. A system for supporting display panels or objects from an overhead support, comprising:

at least two spaced-apart, elongated, hollow, extruded fixed rails which are attachable to an overhead support;

at least one spaced-apart, elongated, hollow, extruded moveable rails;

a plurality of connectors slidably disposed within said moveable rails, said connectors having a squeezingly narrowable projection extending though an elongated gap in said moveable rail and into adjustable receipt in said fixed rail, said moveable rails providing support for a display supporting clip, wherein said connector is slidable within said moveable rail, and wherein said connector has tapered shoulders to permit said slidability within said rail, said fixed rail having an elongated gap for pinched receipt of said narrowable projection of said connector, said connector having a pair of channel lip-engaging flanges disposed thereon for snapping into said gap on an adjoining opposed rail, said fixed rail and said moveable rails being structurally similar to one another, said connector having a transverse axis which is movable along a longitudinal axis of said moveable rail and wherein said tapered shoulders at each end of said connector are connected by a curvilinear main web.

13. A method of providing support for a display panel from an overhead support, comprising:

attaching a first and a second elongated extruded hollow fixed rail to said overhead support;

sliding an arrangement of connectors into an elongated extruded hollow moveable rail, wherein said connectors each have a squeezingly narrowable projection extending out of said moveable rail, through an elongated gap therealong;

squeezing said projection and inserting said squeezed projection extending from said moveable rail into an elongated gap extending along a side portion of each of said fixed rails; and attaching a clip to said moveable rail for support of a display panel or object therefrom.

14. The method as recited in claim 13, including:

attaching at least one other moveable rail to said fixed rails by a further arrangement of connectors extending from said moveable rail.

* * * * *